US005985208A

United States Patent [19]

Zedalis et al.

[11] Patent Number: 5,985,208

[45] Date of Patent: Nov. 16, 1999

[54] PROCESS FOR DEBINDING AND SINTERING METAL INJECTION MOLDED PARTS MADE WITH AN AQUEOUS BINDER

[75] Inventors: Michael Sean Zedalis, Mendham; Bryan C. Sherman, Mine Hill; Jerry C. La Salle, Montclair, all of N.J.

[73] Assignee: AlliedSignal Inc., Morris Township, N.J.

[21] Appl. No.: 09/141,444

[22] Filed: Aug. 27, 1998

[51] Int. Cl.[6] ..... B22F 3/10

[52] U.S. Cl. ..... 419/36; 419/37; 419/54; 419/58

[58] Field of Search ..... 419/36, 37, 54, 419/58

[56] References Cited

U.S. PATENT DOCUMENTS

| | | | |
|---|---|---|---|
| 4,734,237 | 3/1988 | Fanelli et al. | 264/122 |
| 5,250,251 | 10/1993 | Fanelli et al. | 264/328.2 |
| 5,258,155 | 11/1993 | Sekido et al. | 264/109 |
| 5,332,537 | 7/1994 | Hens et al. | 264/22 |
| 5,830,305 | 11/1998 | Anderson et al. | 156/242 |

*Primary Examiner*—Daniel J. Jenkins
*Attorney, Agent, or Firm*—John A. Squires

[57] ABSTRACT

A debinding and sintering method is employed to produce consolidated net shape articles from metal powders including 17-4PH stainless steel alloy by metal injection molding using an agar based aqueous binder. The debinding and sintering step can be combined into one cycle to economically produce components for the consumer and aerospace industries.

16 Claims, 4 Drawing Sheets

PROCESS FOR DEBINDING AND SINTERING METAL INJECTION MOLDED PARTS MADE WITH AN AQUEOUS BINDER

FIELD OF THE INVENTION

This invention relates to a process for debinding and sintering 17-4PH stainless steel and components thereof from metal injection molded powder. More particularly, the invention is directed to a debinding and sintering schedule that attains mechanical properties comparable to cast and wrought 17-4PH components for aerospace and other structural applications. Such components are made by the net shape process of metal injection molding using an aqueous based feedstock binder.

BACKGROUND OF THE INVENTION

DESCRIPTION OF THE PRIOR ART

Stainless steel alloys in the precipitation hardening (PH) class have found ubiquitous application in the aerospace and other high technology industries because of their wide range of mechanical properties. Yield strengths range from 75 to 205 ksi, ultimate strengths from 125 to 220 ksi and elongations from 1 to 25%. Common alloys include the martensitic 15-5PH, semi-austenitic 17-7PH, and austenitic A-286. The martensitic alloy, 17-4PH, has the nominal composition of 17Cr—4Ni—4Cu—2Si—Fe(balance) and has widespread application in aerospace applications.

Stainless steels are typically available in cast or wrought forms but are also available as a powder metallurgy (PM) product. Conventional PM processing of stainless steel includes press and sinter and metal-injection-molding (MIM). Press and sinter results in a compact of only 80 to 85% dense in the sintered condition and is limited to simple geometric shapes such as cylinders. Additional processing such as hot isostatic pressing (HIP) can bring densities to near 100% of theoretical density.

Metal-injection-molding is recognized as a premier forming method for complex shapes, affording significant advantages over other forming methods due to its capability of rapidly producing net shape, complex parts in high volume. Initially, MIM comprised the step of mixing metal powder with a dispersant and a thermoplastic organic binder of variable composition. The molten powder/binder mixture was heated during the injection molding process and injected into a relatively cold mold. After solidification, the part was ejected in a manner similar to injection-molded plastic parts. Subsequently, the binder was removed and the part was densified by a high temperature heat treatment. There were a number of critical stages in this process including the initial mixing of the powder and binder, the injection of the mixture into the mold, and the removal of the organic matrix material. One of the main disadvantages of the initial MIM process is the removal of the organic vehicle. Currently, with organic binder MIM processes the cross section limit of a part for fine particle sizes is typically less than ¼ inch. If the cross section of the part exceeds that limit, the binder removal process will lead to defects, pinholes, cracks, blisters, etc. Binder removal takes place by slow heat treatments that can take up to several weeks. During debinding at elevated temperatures, the binder becomes a liquid, which can result in distortion of the green part due to capillary forces. Another disadvantage of the initial MIM process is the tendency for the relatively high molecular weight organic to decompose throughout the green body, causing internal or external defects. The use of solvent extraction, wherein a portion of the organic is removed using an organic or supercritical liquid, sometimes minimizes defect formation. Solvent extraction causes difficulties because the remainder still needs to be removed at elevated temperatures, resulting in the formation of porosity throughout the part which allows removal of the remaining organic material. During binder removal, part slumping can pose problems, especially for the larger particle sizes if the green density/strength is not high enough.

MIM offers certain advantages for high volume automation of net shape, complex parts. However, the limitation of part size and excessive binder removal times, along with a negative environmental impact resulting from removal of the organic binder material during the debinding process, have inhibited the expected growth of the use of this technique.

Some improvements, such as the use of water based binder systems, have been made to the initial MIM process. Hens et al. developed a water leachable binder system as described in U.S. Pat. No. 5,332,537. The injection molding feedstock is made with a tailored particle size distribution (to control the rheology), a PVA based majority binder, and a coating on each of the binder particles. During molding, these coatings form necks which give the part rigidity. After injection molding, there is a water debind that lasts several hours. After the remaining binder is cross-linked by either UV or chemical methods, the part undergoes a thermal debind, which takes 8–12 hours for a part such as a golf club head. Other aqueous-based binders contain either polyethylene glycols, PVA copolymers, or COOH-containing polymers. BASF has developed a polyacetal-based system that is molded at moderately high temperatures, after which the binder is removed by a heat treatment with gaseous formic or nitric acid. The acid treatment keeps the debind temperature low to exclude the formation of a liquid phase and thus distortion of the green part due to viscous flow. The gaseous catalyst does not penetrate the polymer, and the decomposition takes place only at the interface of the gas and binder, thereby preventing the formation of internal defects. These improvements are limited by the requirement for separate binder removal furnaces and times, depending on the part size. There are environmental issues as well with removal of the large amount of wax/polymer in the form of fire hazards and volatile organic compound discharge.

An injection molding process using agar as an aqueous binder has been developed by Fanelli et al as described in U.S. Pat. No. 4,734,237. This binder system applies to both ceramic and metal powders. It also includes the use of agarose or derivatives of polysaccharide aqueous gels. The advantage over state-of-the-art wax-based binder technology is the use of water as the fluid medium versus wax. In feedstocks prepared according to this technology, water serves the role of the fluid medium in the aqueous injection molding process, comprising roughly 50 volume % of the composition, and agar provides the "setting" function for the molded part. The agar sets up a gel network with open channels in the part, allowing easy removal of the water by evaporation. By contrast the Hens et al system requires a solvent debind to attain similar open channels in the part. The agar is eventually removed thermally; however, it comprises less than 5 volume fraction of the total formation, and debind times are rapid compared to wax/polymeric debind systems. This is an advantage over the Hens et al system.

This agar-based aqueous binder is especially applicable for the production of stainless steel components using MIM. Due to the easy removal of the aqueous-based binder and its relatively low level of carbon, as compared to wax or polymeric binder systems, sintering schedules can be developed which impart little or no additional carbon to stainless steel alloys such as 316L, 410L and 17-4PH. Excessive amounts of carbon, typically above about 0.07 wt % for 17-4PH, for example, seriously compromise the mechanical properties and corrosion resistance of stainless steels. Moreover, the agar-based binder and its associated carbon are removed in a simple one-step, air debinding process consisting of relatively short debind times of approximately ½ to 2 hours. In contrast, wax or polymer based binders require several step debinding processes in which each debind step often takes many more hours. Accordingly, the short air debind times of the agar-based 17-4PH alloy are economically advantageous.

BRIEF SUMMARY OF THE INVENTION

The present invention relates to a debinding and sintering process for an article of manufacture made from a metal powder and an aqueous binder in an injection molding process comprising the steps of raising the temperature of an air atmosphere to a value sufficient to decompose the polysaccharide in the aqueous binder, and then sintering at elevated temperatures in a hydrogen atmosphere to reduce oxidation formed on the article during the debinding step.

This invention is also directed to an injection molding process for a metal powder comprising the following steps:

a) injecting a mixture comprising
   1) a metal in powder form, and
   2) a gel-forming aqueus binder into a mold, the temperature of the mixture prior to injection being maintained at a first level above the gel point of the binder,
b) cooling the mixture in the mold to a second temperature below the gel point of the binder to form a self-supporting article,
c) debinding the article in an air atmosphere by raising the temperature to a value sufficient to decompose the polysaccharide in the aqueous binder, and
d) sintering the article in a hydrogen atmosphere at elevated temperatures to reduce any oxidation formed on the article during the debinding step.

The invention further provides a critical air debinding step prior to sintering which results in high densification and minimization of carbon in 17-4PH stainless steel alloy. However, the air debinding step is not limited to 17-4PH or other stainless steels. Rather, it is applicable to all metal powders utilizing the agar-based aqueous binder system. In addition to the critical air debinding step, this invention also discloses other sintering parameters such as peak sintering temperature and hold time, which in conjunction with the air debinding step, are important in producing injection molded 17-4PH alloy components having mechanical properties comparable to cast or wrought processed material.

DETAILED DESCRIPTION OF THE INVENTION

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLE 1

This example describes the criticality of an air debinding step prior to sintering in order to prevent excessive carbon in the 17-4PH stainless steel alloy. 17-4PH feedstock was compounded using argon atomized 17-4PH stainless steel powder of minus 20 micrometer size purchased from Ultrafine Metals, Inc. The 17-4PH powder was mixed with agar (S-100, Frutarom Meer Corp), water, and calcium borate to have the composition (in wt %) of 92.5% 17-4PH, 1.7% agar, 5.7% water, and 0.1% calcium borate. Compounding was performed in a sigma blender that was heated to 88° C. for 45 minutes, after which the temperature was reduced to 77° C., and mixing continued for another 45 minutes. After the material was allowed to cool to room temperature, it was shredded using a food processor (Kitchen Aid KSM90) and sieved using a #5 sieve to remove any large and fine shards. Before being molded, the shredded feed-stock was dried to a desired solids level by exposing a loose bed of material to the atmosphere. Solids loadings were determined using a moisture balance (Ohaus Corp.). Injection molding of the feedstock into tensile specimens was next performed. This was accomplished on a 55 ton Cincinnati Milacron injection molding machine at 85° C. using a fill pressure of 200 psi and a mold pressure of 100 psi by forming the feedstock into an epoxy tensile bar mold. Such parts, after injection molding but before sintering, are referred to as "green" parts.

The tensile bars were next divided into sixteen batches and run in a 5 factor-2 level fractional factorial design of experiment (DOE), which was analyzed by MINITAB statistical software. The five factors used as inputs and their levels are summarized in Table I. The output value for the analysis is the carbon level, with low levels being the desired result. A total of sixteen experimental debind/sintering runs were performed in a laboratory tube furnace. All sintered tensile bars were given a specified heat treatment of 1 hour austenitizing at 1038° C. followed by an air quench to room temperature. Aging was performed to H1025 temper by heating at 552° C. for 4 hours. The MINITAB statistical software was then utilized to determine the factors important for the minimization of carbon and oxygen in the debinding and sintering operation of the agar-based aqueous 17-4PH green tensile bars.

TABLE I

| Factor | Low Value | High Value |
|---|---|---|
| Debind atmosphere | Hydrogen | Air |
| Hold at 450° C. | 0 hr | 2 hr |
| Hold at 1010° C. | 0 hr | 2 hr |
| Sintering Temperature | 1329° C. | 1360° C. |
| Sintering Time | 30 min | 90 min |

Figure 1:
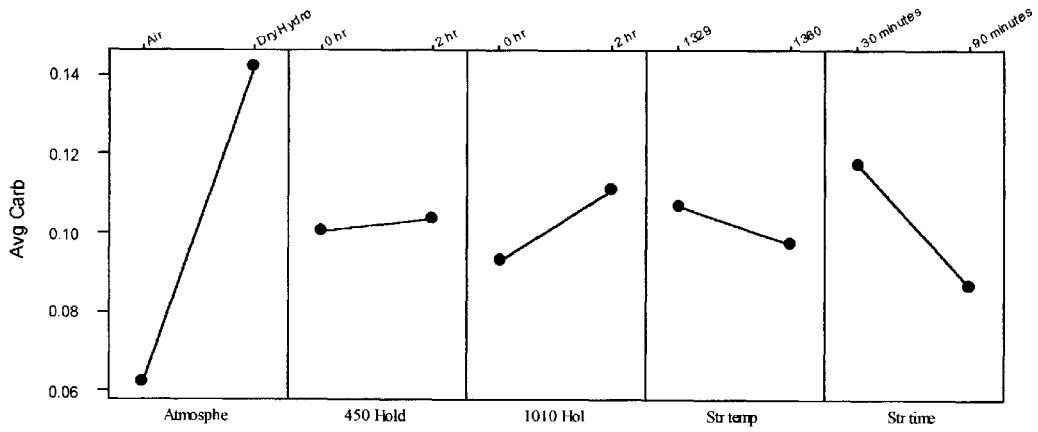
FIG. 1 are Paretto and Main Effects plots from the Statistical Software Package MINITAB which show that of the five factors tested, debinding in an air atmosphere is the most significant factor in minimizing carbon.
Figure 1:
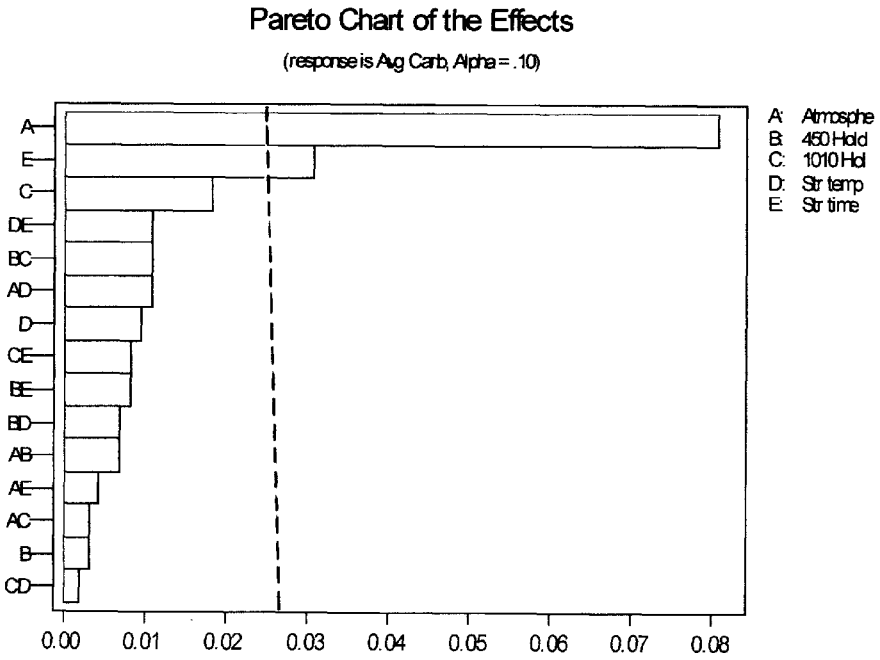

FIG. 1 shows the Main Effects and Paretto chart from the MINITAB statistical software. In the Paretto chart factors appearing to the right of the dotted line are considered statistically significant, while those to the left are statistically insignificant. The Paretto chart clearly indicates that debinding in an air atmosphere as opposed to a hydrogen atmosphere results in a dramatic minimization of carbon. The Paretto chart indicates that the sintering time also plays a role in carbon reduction. The magnitude of the effects is shown in the Main Effects plot in FIG. 1, which shows that air debinding can result in carbon levels as low as 0.06%, while debinding in a hydrogen atmosphere results in carbon levels of 0.14%, more than double.

EXAMPLE 2

Figure 2:
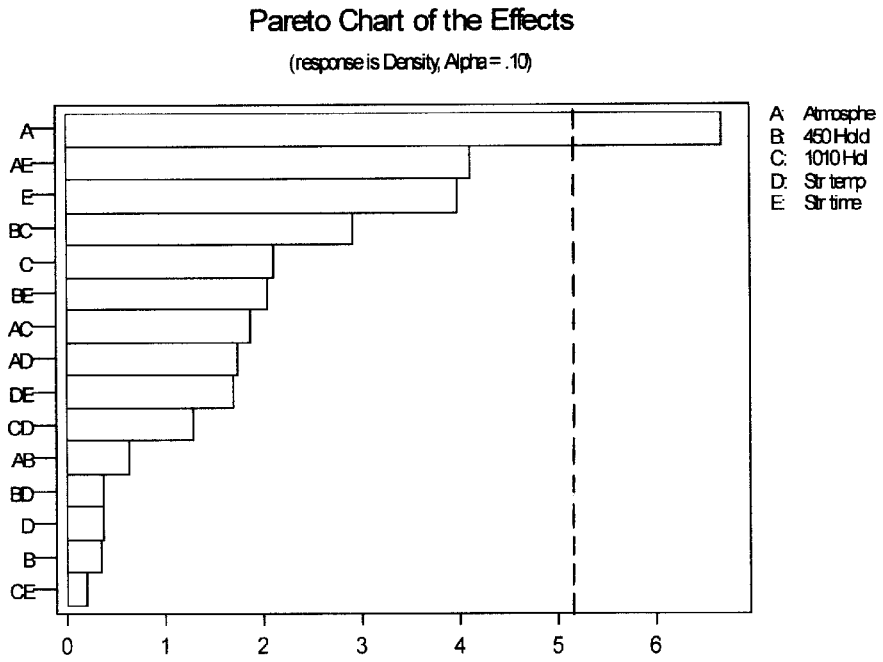
FIG. 2 are similar plots which show that air debinding is significant in maximizing density in excess of 99%.
Figure 2:
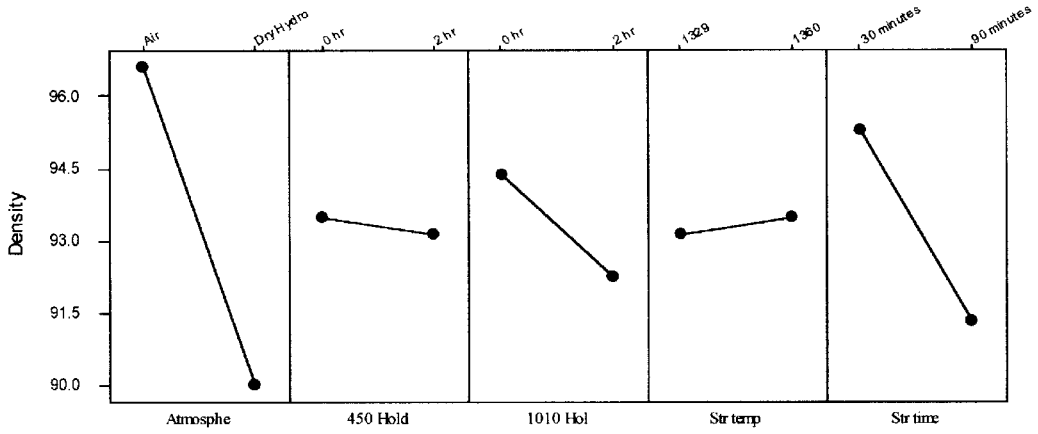

This example describes the criticality of an air debinding step prior to sintering for 17-4PH stainless steel alloy in order to achieve densities in excess of 99% after sintering. Samples were prepared and analyzed using MINITAB, as described in Example 1. The Paretto and Main Effects plots using final density as an output are shown in FIG. 2. The Paretto chart indicates that the debinding atmosphere is the only significant factor for obtaining maximum density within the factors and levels analyzed in this 16 run experiment. Examination of the main effects plots shows that the air debind produces a maximum of >98% density, while a hydrogen debind shows only a 90% density.

EXAMPLE 3

Figure 3:
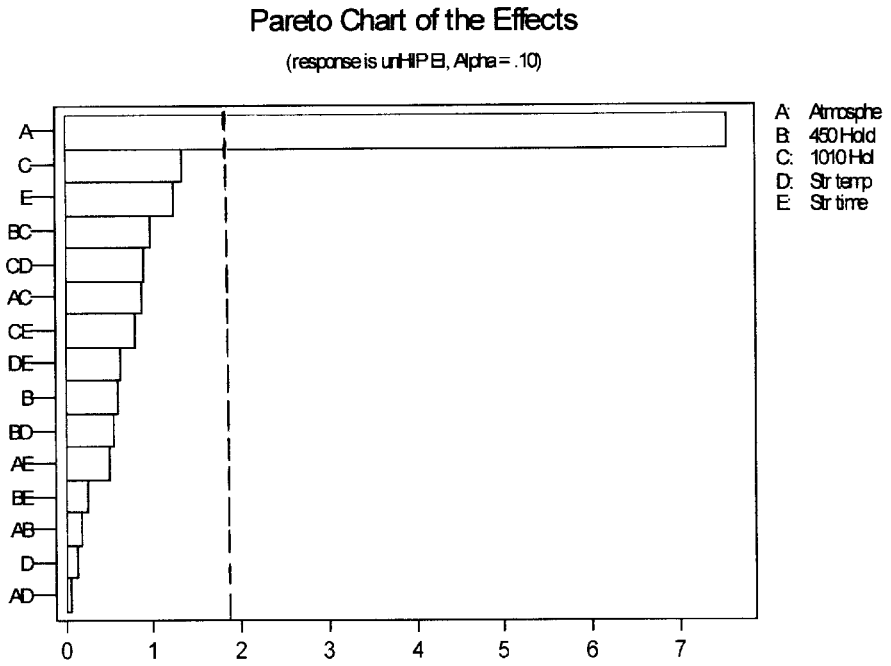
FIG. 3 are similar plots which show that debinding in an air atmosphere is significant in maximizing tensile elongation in an unHIPed 17-4PH stainless steel alloy heat treated to the H1025 condition.
Figure 3:
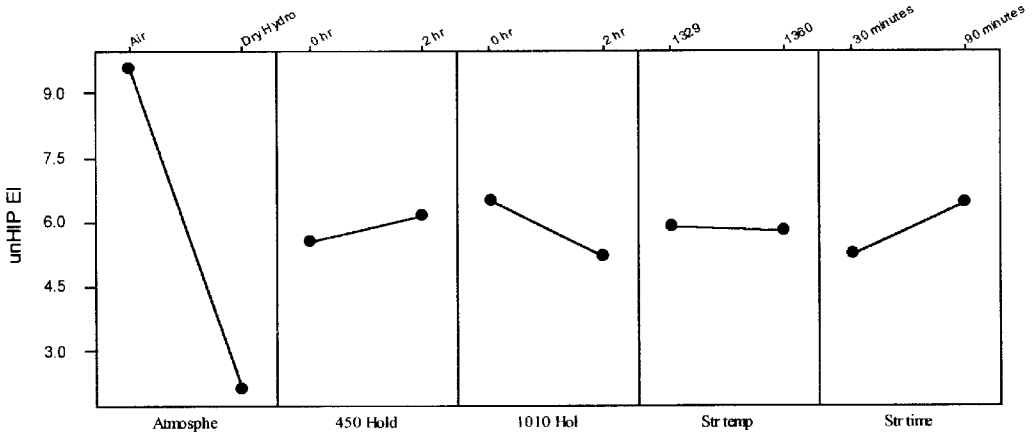

This example describes the criticality of an air debinding step prior to sintering in order to achieve tensile elongations in the range of 9% after sintering in 17-4PH stainless steel alloy heat treated to the H1025 condition. Samples were prepared and analyzed using MINITAB, as described in Example 1. The Paretto and Main Effects plots using tensile elongation as an output are shown in FIG. 3. The Paretto chart indicates that the debinding atmosphere is the only significant factor for obtaining maximum tensile elongation within the factors and levels analyzed in this 16 run experiment. Examination of the Main Effects plots shows that the air debind results in a maximum of >10% tensile elongation, while debinding in a hydrogen atmosphere produces only a 2% elongation.

EXAMPLE 4

This example shows that a sintering run using the optimized parameters from the 16 level DOE described in Example 1 will result in as-sintered, H1025 treated MIM 17-4PH material having tensile properties comparable to H1025 treated 17-4PH produced conventionally by either cast or wrought processing. The tensile properties for material produced by these three methods are listed in Table II. The MIM 17-4PH alloy test bars of this example represent the average of three tests. Wrought and cast minimums listed in Table II are from the Aerospace Structural Metals Handbook.

TABLE II

| | YS | St Dev | UTS | St Dev | El | St Dev |
|---|---|---|---|---|---|---|
| Agar based MIM H1025 | 131.5 | 2.6 | 159.6 | 2.1 | 11.7 | 0.9 |
| Wrought AMS5604C H1025 | 145 | | 155 | | 5 | |
| Investment cast test bar H1025 | 130 | | 150 | | 10 | |

EXAMPLE 5

This example shows the beneficial effect of using a HIP treatment after sintering but before austenization and aging. Nine test bars fabricated as in Example 4 were HIPed using the standard industrial HIP cycle of 15 ksi argon pressure at 1162° C. for 4 hours after sintering. The samples were then austenitized and given the H1025 treatment described previously. The tensile results are listed in Table III along with BROWSE data for cast and wrought processed 17-4PH in the H1025 condition. Table III includes the average minus three sigma values that are an indication of variability in properties from sample to sample. For aerospace applications, average minus 3 sigma values are used for qualification. The tensile elongation average minus 3 sigma values are significantly higher for the HIPed MIM specimens than for the cast specimens.

TABLE III

| | YS(ksi) | UTS(ksi) | EL(%) | |
|---|---|---|---|---|
| global average MIM 17-4PH | 132.1 | 151.2 | 11.1 | |
| standard deviation | 2.2 | 1.2 | 0.6 | |
| avg. minus 3 sigma | 125.6 | 147.7 | 9.3 | |
| wrought 17-4PH | 159 | 164 | 13 | BROWSE DATA |
| avg. minus 3 sigma | 144 | 149 | 10 | BROWSE DATA |
| cast 17-4PH | 153 | 160 | 11 | BROWSE DATA |
| avg. minus 3 sigma | 142 | 147 | 3.6 | BROWSE DATA |

EXAMPLE 6

Figure 4:
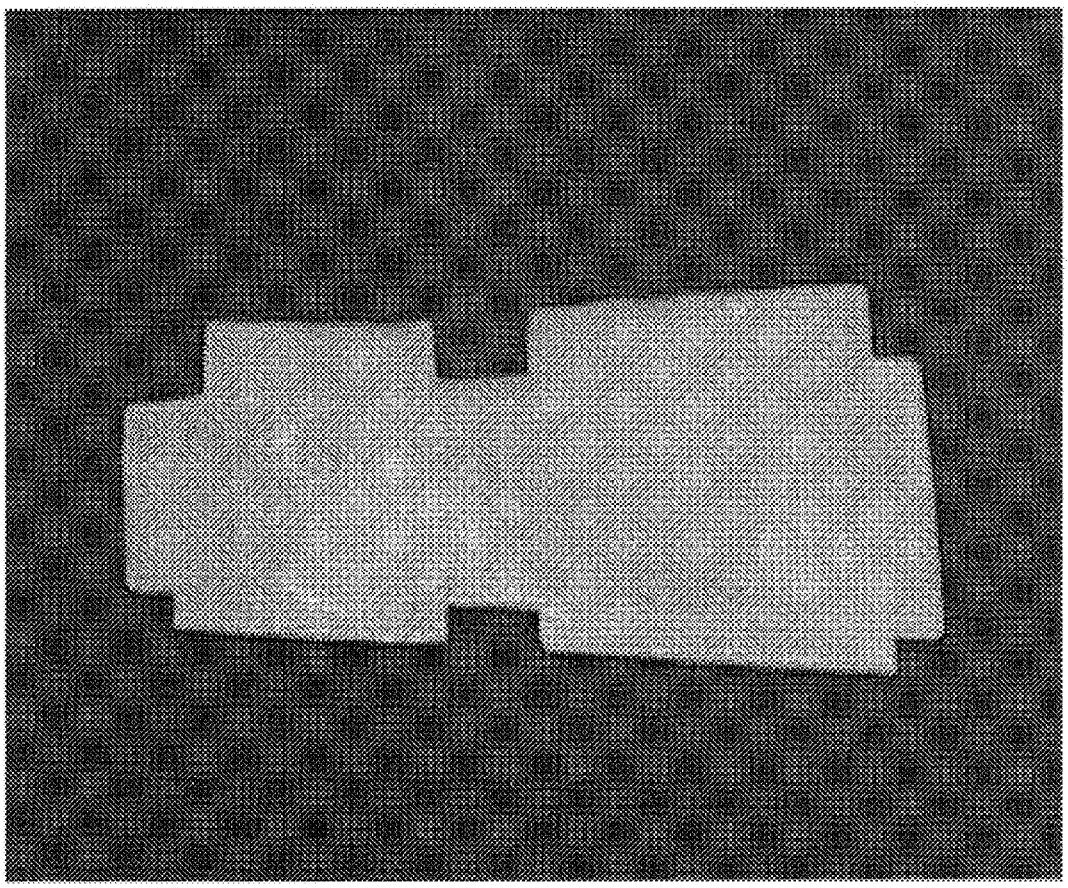
FIG. 4 is a photograph of a 507 jet engine diffuser vane produced using the agar based feedstock in a 17-4PH stainless steel alloy.

This example illustrates the production by M of an aerospace component made using the agar-based water soluble binder in alloy 17-4PH. FIG. 4 shows a photograph of a 507 diffuser vane for an Allied Signal jet engine. The vane was made in a manner similar to the tensile bars of Example 1. However, the epoxy mold employed was that of the diffuser vane instead of the tensile bar mold.

EXAMPLE 7

This example illustrates that low carbon levels can be achieved in samples having various cross sectional thicknesses. Alloy 17-4PH was prepared as described in Example 1, except that five step samples were molded instead of tensile bars. The five step samples are designed to test the variation of properties with respect to thickness and consist of five sections, each having a greater thickness than the p receding section. Table IV lists the carbon, oxygen and nitrogen values from a five step sample in which thickness varied from 0.882 inches to 0.048 inches. The table reveals carbon levels below 0.04 wt % even for the thickest section of sample.

TABLE IV

| | Carbon(wt %) | Oxygen | Nitrogen | Step Width (inches) |
|---|---|---|---|---|
| 13A | 0.0339 | 0.0230 | 0.074 | 0.882 |
| 13B | 0.0340 | 0.0170 | 0.051 | 0.355 |
| 13C | 0.0255 | 0.0092 | 0.028 | 0.184 |
| 13D | 0.0080 | 0.0029 | 0.030 | 0.060 |
| 13E | 0.0102 | 0.0022 | 0.022 | 0.048 |

EXAMPLE 8

This example illustrates that the air debinding process is also applicable to the stainless steel alloy 316L in minimizing carbon and maximizing theoretical density. Samples were prepared as in Example 1, substituting the 316L alloy for 17-4PH alloy. Debinding and sintering temperatures were 450° C. and 1375° C., respectively, reflecting the optimum conditions for the chemistry of this alloy. The samples were divided into two lots. First, they were debound in air and subsequently sintered in hydrogen; and then they were debound and sintered entirely in hydrogen. A statistical sample of 10 pieces was measured. Samples debound in air had a theoretical density of approximately 99.5±0.22% and a carbon value of about 0.006±0.003 wt %. Samples debound in hydrogen had a lower density of approximately 98.7±0.45% and a much greater carbon value of about 0.09±0.02 wt %. It is noted that the carbon specification for 316L alloy is below 0.07%. Values greater than 0.07%, such as the 0.09 value obtained for the hydrogen debound material, will result in inferior corrosion resistance.

EXAMPLE 9

This example illustrates that the air debinding process is also applicable to the stainless steel alloy 410L in minimizing carbon and maximizing theoretical density. Samples were prepared as in Example 1, substituting the 410 L alloy for 17-4PH alloy. Debinding and sintering temperatures were 225° C. and 1343° C., respectively, reflecting the optimum conditions for the chemistry of this alloy. The samples were divided into two lots. First, they were debound in air and subsequently sintered in hydrogen; and then they were debound and sintered entirely in hydrogen. A statistical sample of 76 pieces was measured. Samples debound in air had a theoretical density of approximately 99.12±0.14%, while samples debound in hydrogen had a lower density of approximately 96.2±0.32%.

It should be noted that the present invention is not limited to the use of agar-based aqueous binders, but could be utilized with any other aqueous-based binder after the network of open channels has been formed in the part.

Having thus described the invention in rather full detail, it will be understood that such detail need not be strictly adhered to but that various changes and modifications may suggest themselves to one skilled in the art, all falling within the scope of the invention as defined by the subjoined claims.

What is claimed is:

1. A process for debinding and sintering an article of manufacture made in an injection molding process from a metal powder and an aqueous binder comprising the steps of:

a) in an air atmosphere raising the temperature to a value sufficient to decompose the polysaccharide in the aqueous binder; and b) in a hydrogen atmosphere sintering at elevated temperatures to reduce oxidation formed on the article during the debinding step.

2. The process of claim 1, wherein the metal powder is 17-4PH stainless steel.

3. The process of claim 1, wherein the metal powder is 316L stainless steel.

4. The process of claim 1, wherein the metal powder is 410L stainless steel.

5. The process of claim 2, wherein the temperature of the air atmosphere is raised to a value below 350° C.

6. The process of claim 5, wherein the temperature of the hydrogen atmosphere is in a range from about 1329° C. to about 1360° C.

7. An injection molding process for a metal powder comprising the steps of:

a) injecting a mixture comprising (1) a metal in powder form, and (2) a gel-forming aqueous binder into a mold, the mixture being maintained prior to the injection step at a first temperature above the gel point of the binder;

b) cooling the mixture in the mold to a second temperature below the gel point of the binder to form a self-supporting article;

c) debinding the article in an air atmosphere by raising the temperature to a value sufficient to decompose the polysaccharide in the aqueous binder; and d) sintering the article in a hydrogen atmosphere at elevated temperatures to reduce any oxidation formed on the article during the debinding step.

8. The process of claim 7, wherein the metal powder is 17-4PH stainless steel.

9. The process of claim 7, wherein the metal powder is 316L stainless steel.

10. The process of claim 7, wherein the metal powder is 410L stainless steel.

11. The process of claim 7, wherein the aqueous binder is a polysaccharide material.

12. The process of claim 8, wherein the temperature during the debinding step is maintained below 350° C.

13. An article of manufacture produced by the process of claim 12.

14. The article of manufacture of claim 13, wherein the density of the article is greater than 98%.

15. The article of manufacture of claim 13, wherein the carbon level of the article is below 0.07%.

16. The article of manufacture of claim 13, wherein the article has a preferred carbon level between 0.02% and 0.05%.

* * * * *